US006447324B1

(12) United States Patent
Nimura et al.

(10) Patent No.: US 6,447,324 B1
(45) Date of Patent: Sep. 10, 2002

(54) TERMINAL FITTING AND A PRODUCTION METHOD

(75) Inventors: Kazuhiko Nimura; Masahiko Aoyama; Eiji Kojima, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 59 days.

(21) Appl. No.: 09/587,068

(22) Filed: Jun. 2, 2000

(30) Foreign Application Priority Data

Jun. 4, 1999 (JP) ..... 11-158627

(51) Int. Cl.[7] ..... H01R 11/20

(52) U.S. Cl. ..... 439/397; 439/399; 439/400; 439/406; 439/407; 439/401; 439/886; 174/99 R

(58) Field of Search ..... 174/99 R; 439/397, 439/399, 400, 406, 407, 401, 886

(56) References Cited

U.S. PATENT DOCUMENTS 3,824,527 A * 7/1974 Evans ..... 439/97 R
4,040,702 A * 8/1977 McKee et al. ..... 439/97 R
4,346,955 A * 8/1982 Chesnais et al. ..... 439/97 R
4,427,251 A 1/1984 Mathe et al.
4,948,382 A * 8/1990 Marpoe Jr. et al. ..... 439/406
5,879,183 A * 3/1999 Okabe ..... 439/397
5,924,887 A * 7/1999 Aoyama et al. ..... 439/400
5,997,336 A * 12/1999 Yamamoto et al. ..... 439/397
6,012,942 A * 1/2000 Volstorf ..... 439/397
6,019,626 A * 2/2000 Abe ..... 439/399
6,080,005 A * 6/2000 Aoyama et al. ..... 439/397

FOREIGN PATENT DOCUMENTS

EP 0 352 966 1/1990
EP 0 722 197 7/1996

* cited by examiner

*Primary Examiner*—Dean A. Reichard
*Assistant Examiner*—Jinhee Lee
(74) *Attorney, Agent, or Firm*—Anthony J. Casella; Gerald E. Hespos

(57) ABSTRACT

A cramping terminal fitting is provided to maintain a satisfactory contact state with a wire without applying plating again after shaping the terminal fitting by a press. The terminal fitting includes insulation displacement contact (IDC) portions (6) into which a wire can be pushed. Each IDC portion (6) is comprised of a contact portion (9) formed by embossing side walls (5) in such a manner as to have a triangular cross section, and cutting blades (8) formed by bending long pieces (18) and short pieces (17) to have a triangular cross section. Further, guide portions (10) for guiding the wire to the IDC portions (6) are provided above the cutting blades (8). Since the contact portions (9) remain plated, a contact state with the wire can be satisfactorily maintained.

8 Claims, 9 Drawing Sheets

TERMINAL FITTING AND A PRODUCTION METHOD

FIELD OF THE INVENTION

The present invention relates to a cramping terminal fitting or an insulation displacement terminal fitting and to a production method therefor.

DESCRIPTION OF THE RELATED ART

A prior art cramping terminal fitting is disclosed in Japanese Unexamined Patent Publication 6-333613 and is identified by the numeral 100 in FIGS. 11 and 12 of this application. A middle portion of the prior art cramping terminal fitting 100 is provided with insulation displacement contact (IDC) portions 101 for making cuts in an insulation coating of an unillustrated insulated wire. Each IDC portion 101 is substantially U-shaped and opens upwardly as shown in FIG. 12. Cutting blades 102 are provided at the opening edge of the IDC portion 101 for cutting the insulation coating of the wire, and a contact portion 103 is provided below the cutting blades 102 for contacting the core of the wire.

The cramping terminal fitting is formed from an electrically conductive plate material that is plated for anticorrosion purposes before being pressed. However, the plating comes off the prior art cramping terminal fitting 100 during the formation of cut ends, including the cut ends that define the cutting blades 102 and the contact portion 103. As a result, a second plating needs to be applied after the prior art cramping terminal fitting 100 is shaped by a press. The second plating plates the cut ends that define the cutting blades 102 and the contact portion 103, and thus ensures that a satisfactory contact state is maintained between the contact portion 103 and the wire.

Another prior art electrical connection member is disclosed in EP 0 352 966 B1. The prior art electrical connection member shown in EP 0 352 966 B 1 has a channel into which a wire can be inserted and in which insulation severing edge surfaces are provided. The insulation severing edge surfaces converge toward each other and are dimensioned to contact the wire inserted into the channel. As a result, the insulation severing edge surfaces displace the insulation coating on the wire. This prior art electrical connection member further includes arcuate dimples in the walls of the channel. The arcuate dimples define bowed portions that have crests. Further insertion of the wire into the channel causes the crests of the bowed portions to enter the incisions made by the insulation severing edge surfaces. Thus, the crests of these bowed portions on the prior art electrical connection member contact the core of the wire. However, the core of the wire may be contacted improperly by the bowed portions when the wire is not oriented completely and/or properly.

The present invention was developed in view of the above problem, and an object of the invention is to provide a terminal fitting which comprises an improved cutting blade that can maintain a satisfactory contact state with a wire without applying a second plating after the terminal fitting is shaped by a press.

SUMMARY OF THE INVENTION

The subject invention is directed to a terminal fitting for a wire that has an electrically conductive core and an insulation coating. The terminal fitting is formed from an electrically conductive plate member that has been plated on one surface. The plate member is formed to define sidewalls. At least one insulation displacement contact portion is formed between the sidewalls and is open to one side of the terminal fitting. Thus, the wire can be pushed transversely into the insulation displacement contact portion of the terminal fitting. The insulation displacement contact portion comprises cutting blades for cutting the insulation coating and at least one contact portion for contacting the core. The contact portion is below the cutting blades along the insertion direction of the insulated wire, and is defined by an inward embossment on at least one sidewall. The embossment may be of substantially triangular cross section and may be dimensioned for tightly holding the core of the wire. least one sidewall. The embossment may be of substantially triangular cross section and may be dimensioned for tightly holding the core of the wire.

Accordingly, the cutting blades cut the insulation coating and the contact portion, which is provided below the cutting blades, is brought into contact with the core as the insulated wire is pushed further into the insulation displacement contact portion. The contact portion is formed by inward embossments on the sidewalls of the terminal fitting. As a result, a satisfactory contact state can be maintained without peeling the plating on the front surface.

The terminal fitting may further comprise a guide portion above the cutting blades for guiding the wire to the cutting blades. Accordingly, the insulation coating of the wire is cut smoothly since the wire is guided to the cutting blades by the guide portion. The guide portion may have an inclined portion with an inclination angle that is substantially the same as an inclination angle of the cutting blades.

The cutting blades are formed by edges of cut ends that are obtained when the electrically conductive plate member is bent. End positions of the edges are aligned with an upper end of the contact portion.

At least one opening may be formed in a portion of the bottom of the terminal fitting where the insulation displacement contact portion is formed. The opening avoids distortion of the terminal fitting, which could occur when the insulation displacement contact portion is formed by embossing.

According to the invention, there is further provided a method for producing a terminal fitting. The method comprises providing at least one insulation displacement contact portion that is electrically connectable with a core of an insulated wire by making cuts in an insulation coating as the insulated wire is pushed into the insulation displacement contact portion. The insulation displacement contact portion may be formed by embossing one or more opposed sidewalls of the terminal fitting inwardly such that the embossed portions have a substantially triangular cross section. The embossments form one or more cutting blades for making cuts in the insulation coating of the insulated wire and one or more contact portions which are provided below or behind the cutting blades as seen in an insertion direction of the insulated wire. The contact portions then may be brought into contact with the core.

According to a further preferred embodiment, the method further comprises a step of bending an electrically conductive plate member and/or plating a front surface thereof.

These and other objects, features and advantages of the present invention will become more apparent upon a reading of the following detailed description and accompanying drawings.

DETAILED DESCRIPTION OF THE EMBODIMENT

Figure 1:
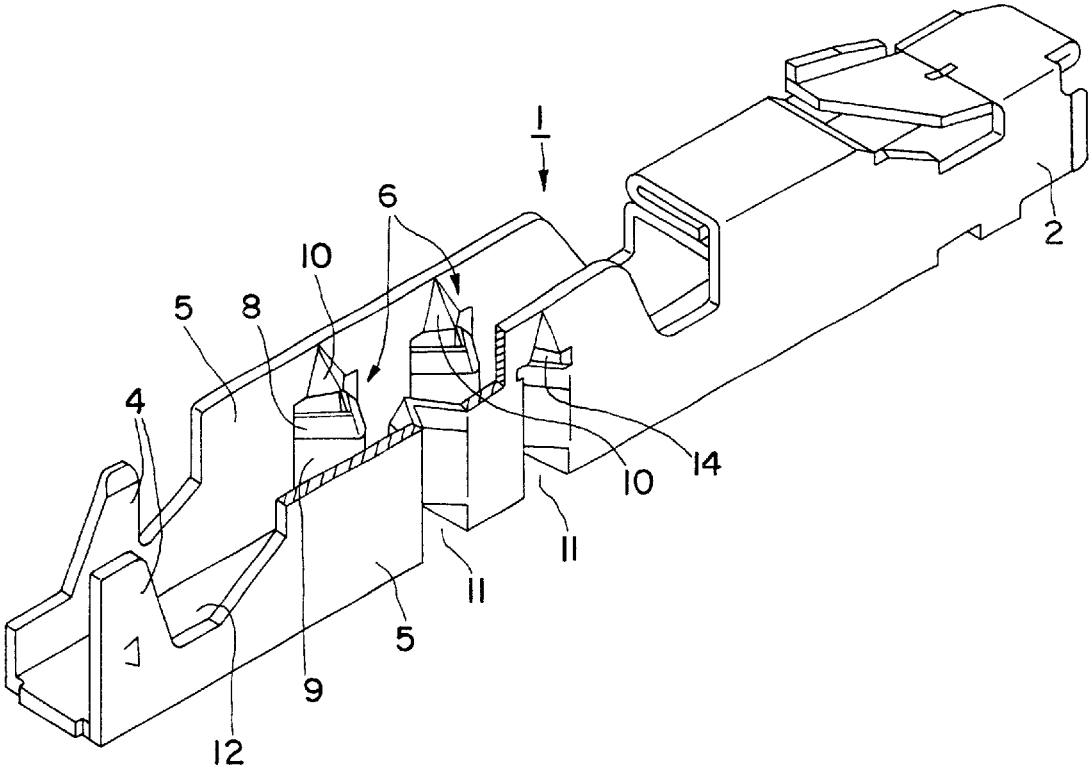
FIG. 1 is a perspective- view partly in section of a terminal fitting according to one embodiment.
Figure 2:
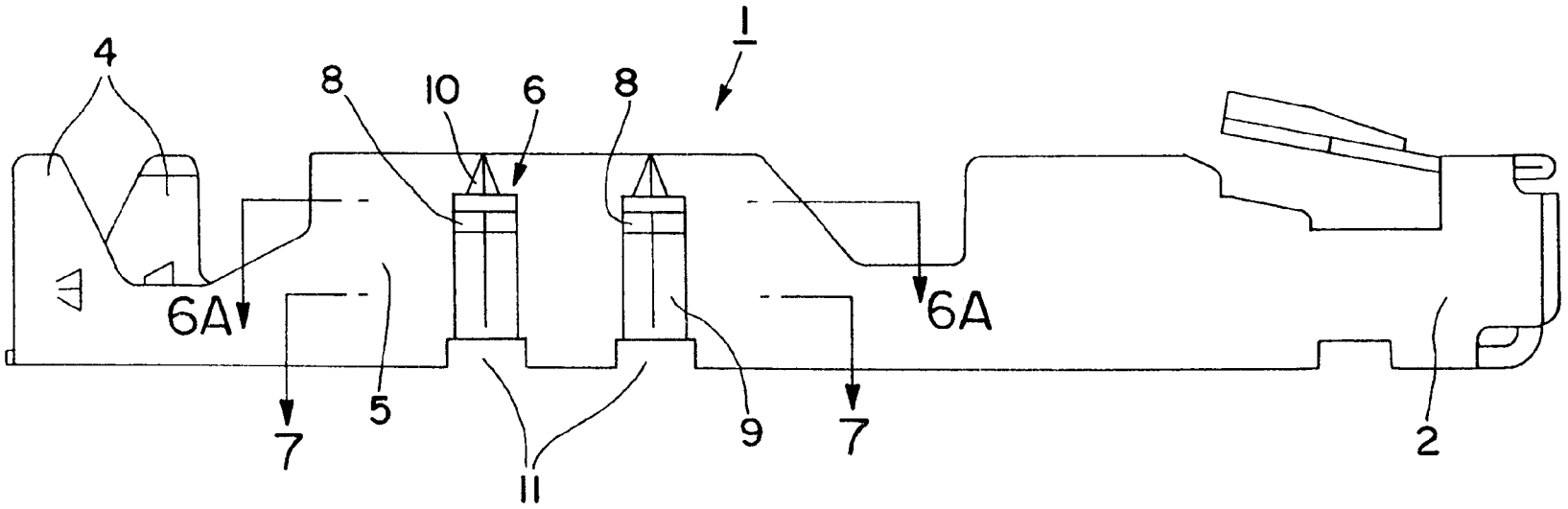
FIG. 2 is a side view of the cramping terminal fitting.
Figure 3:
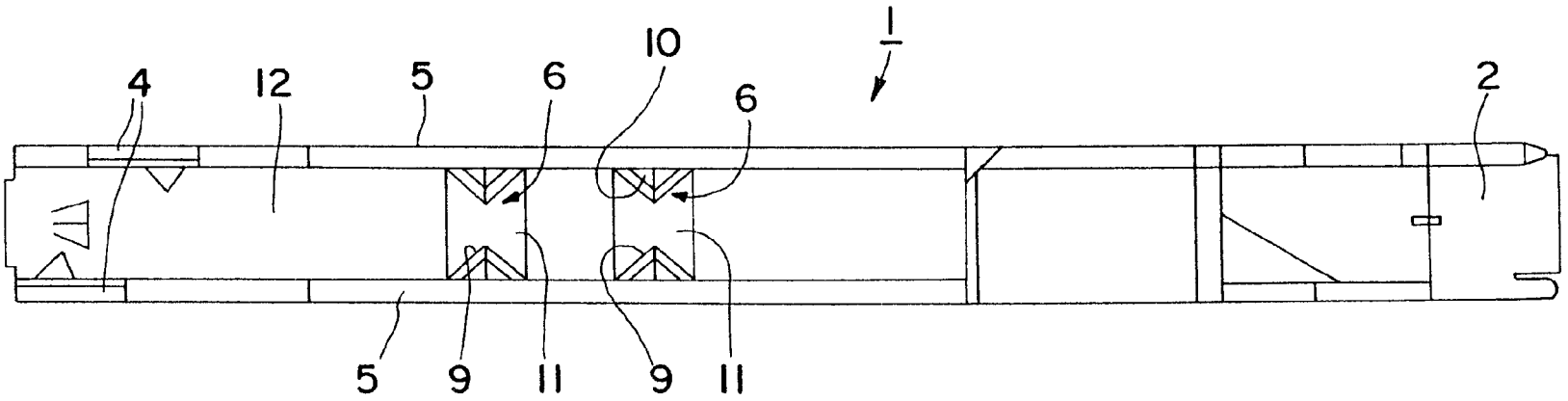
FIG. 3 is a plan view of the cramping terminal fitting.
Figure 4:
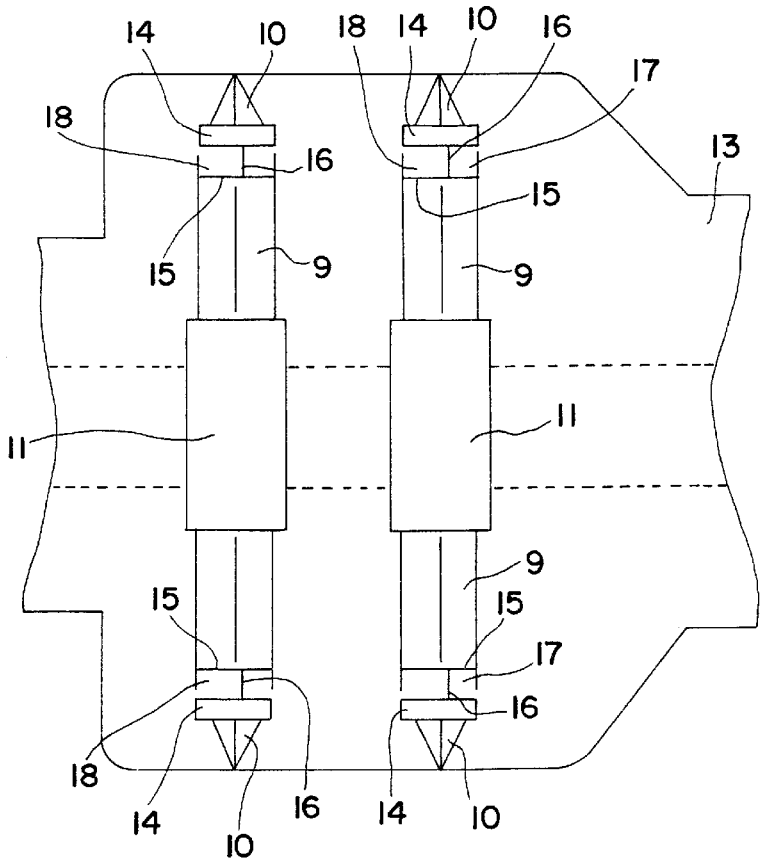
FIG. 4 is a plan view of a portion of an electrically conductive plate member near IDC portions of the cramping terminal fitting before bending.
Figure 5:
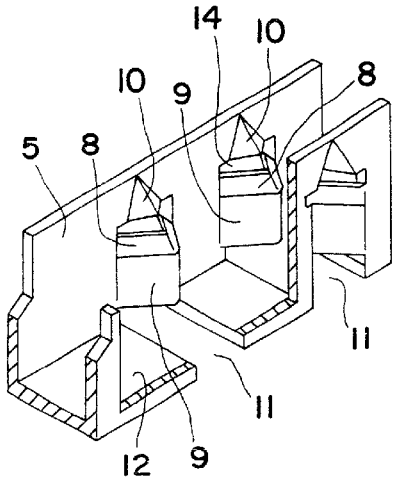
FIG. 5 is a perspective view partly in section of the IDC portions.

A terminal fitting in accordance with the subject, invention is identified generally by the numeral 1 in FIGS. 1–3 and 5–10. The terminal fitting 1 preferably is formed from an electrically conductive plate member 13, as shown in FIG. 4. The plate member 13 initially is stamped by a press, and then has its front surface plated. The plate member 13 then is bent into the terminal fitting 1, as shown in FIGS. 1–3 and 5–10.

The front part of the terminal fitting 1 is formed to include a connecting portion 2 that is substantially in the form of a rectangular column. The connecting portion 2 is connectable with an unillustrated mating terminal fitting. The rear part of the terminal fitting 1 is formed to include barrel portions 4 that project upward from left and right sidewalls 5 of the terminal fitting 1. The barrel portions 4 preferably are longitudinally offset from one another, and can be crimped or folded over for fastening to an insulation coating 3A of an insulated wire 3. A terminal fitting with such barrel portions 4 often is referred to in the art as a cramping terminal fitting. Two insulation displacement contact (IDC) portions 6 are provided between the front and rear of the terminal fitting 1. The IDC portions 6 are to be connected electrically with a core 3B of the wire 3 by making cuts in the insulation coating 3A as the wire 3 is pressed transversely into the space between the sidewalls 5.

Figure 8:
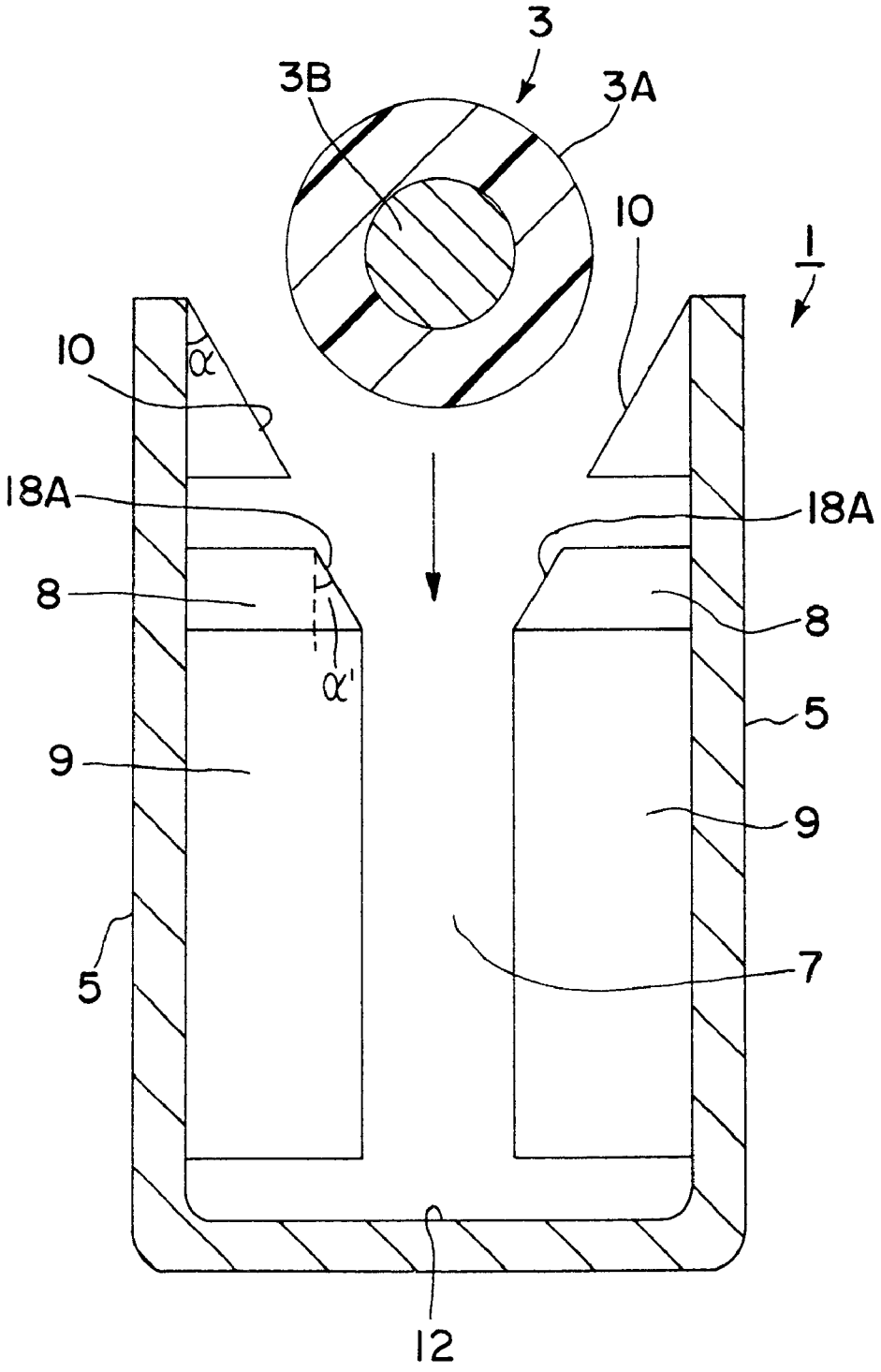
FIG. 8 is a section showing a state before an insulated wire is mounted in the IDC portion.
Figure 9:
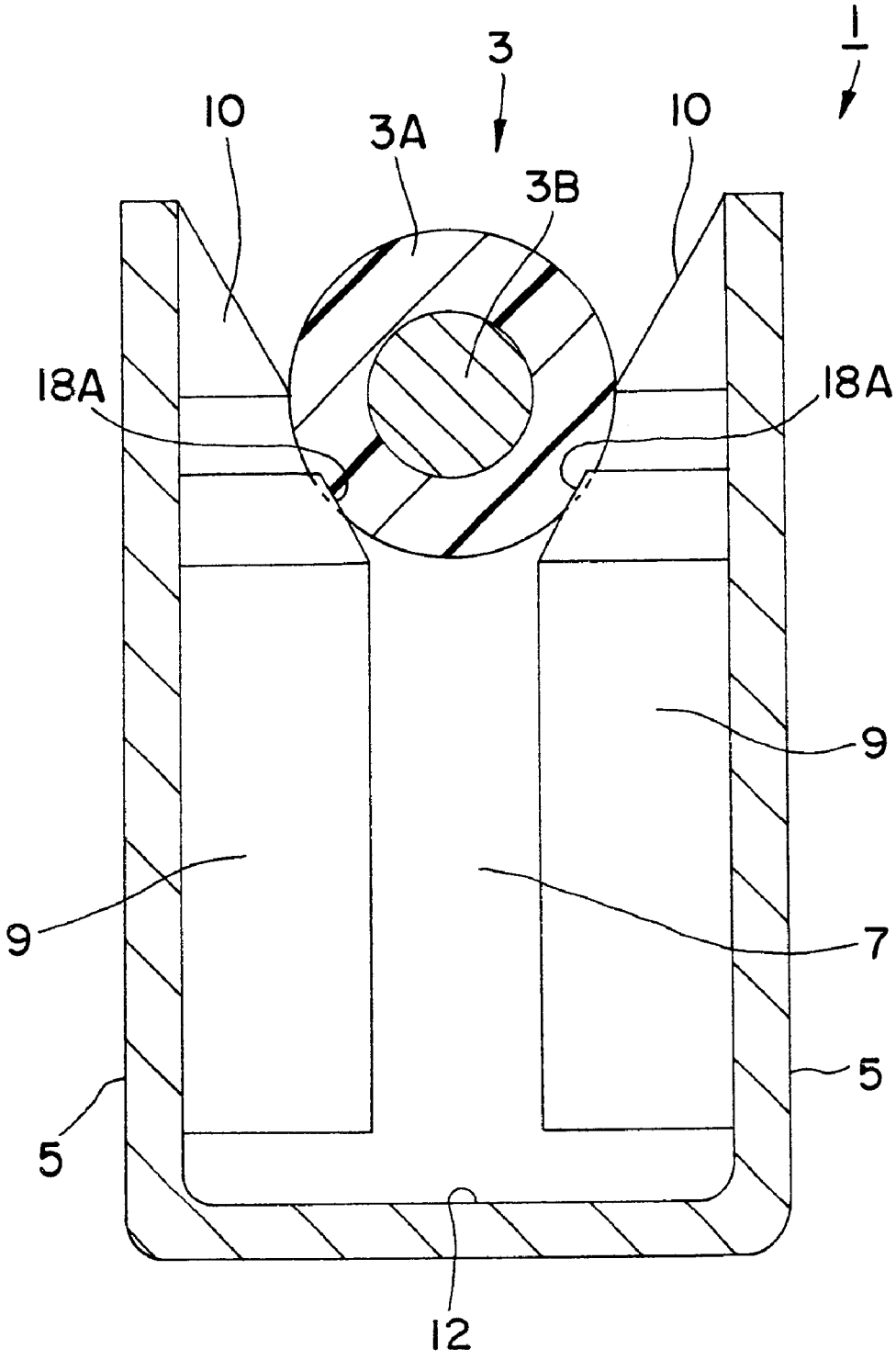
FIG. 9 is a section showing an intermediate state of the mounting of the insulated wire in the IDC portion.

The IDC portions 6 are spaced along the length of the cramping terminal fitting 1 and are substantially symmetrically formed on the left and right side walls 5. Grooves 7 are defined centrally between the sidewalls 5 at each IDC portion 6. The grooves 7 are dimensioned to receive the wire 3, as illustrated in FIGS. 8 and 9, and as described further below. Each IDC portion 6 is comprised of cutting blades 8 for cutting the insulation coating 3A of the wire 3, and a contact portion 9. The contact portion 9 of each IDC portion 6 is provided below the cutting blades 8 and is configured for connection with the core 3B of the wire 3. As described later, each contact portion 9 preferably is formed by embossing sections of the left and right side walls 5 to have a triangular horizontal section with a ridge at the apex of the triangle. The embossments are dimensioned so that the core 3B can be held tightly between the opposing ridges of the contact portions 9. Preferably, the contact portions 9 are contiguous to the cutting blades 8 so as to be substantially continuous therewith. Thus, a wire inserted therein can be contacted properly.

The cutting blades 8 also have a substantially triangular horizontal cross section. The edges of the cutting blades 8 are slanted in directions away from each other as they extend upwardly so that the insulation coating 3A of the wires 3 can be cut smoothly.

Guide portions 10 are provided above the cutting blades 8 at the left and right side walls 5 for guiding the wire 3 into clearances between the cutting blades 8. The bottom ends of the guide portions 10 and the top ends of the cutting blades 8 are spaced apart by small openings 14. Further, the guide portions 10 are formed by embossing the sidewalls 5 to bulge inward and to have a cross section in the form of an isosceles triangle. Ridges in the middle of the guide portions 10 slant toward the grooves 7 as they extend down and away from the respective sidewall 5. More particularly, the guide portions 10 define an angle of inclination "$\alpha$" that is substantially equal to the angle of inclination $\alpha'$ of the cutting blades 8, as shown in FIG. 8. Additionally the inclined edges of the guide portion 10 and the cutting blades 8 are substantially collinear. Thus, the wire 3 can be guided smoothly into the groove 7.

Longitudinally spaced openings 11 are formed in a bottom wall 12 of the terminal fitting 1 at locations substantially aligned with the contact portions 9. The openings 11 prevent the bottom wall 12 from being deformed during the embossing of the sidewalls 5 to form the contact portions 9.

Figure 6A:
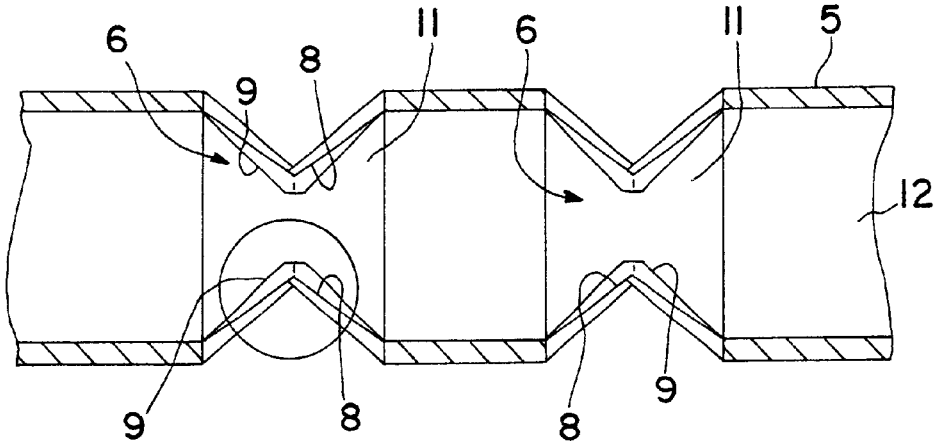
FIG. 6(A) is a section along 6A—6A of FIG. 2.
Figure 6B:
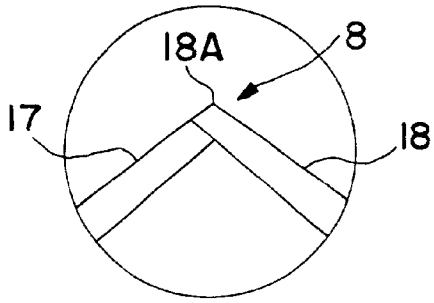
FIG. 6(B) is an enlarged plan view of a cutting blade.
Figure 7:
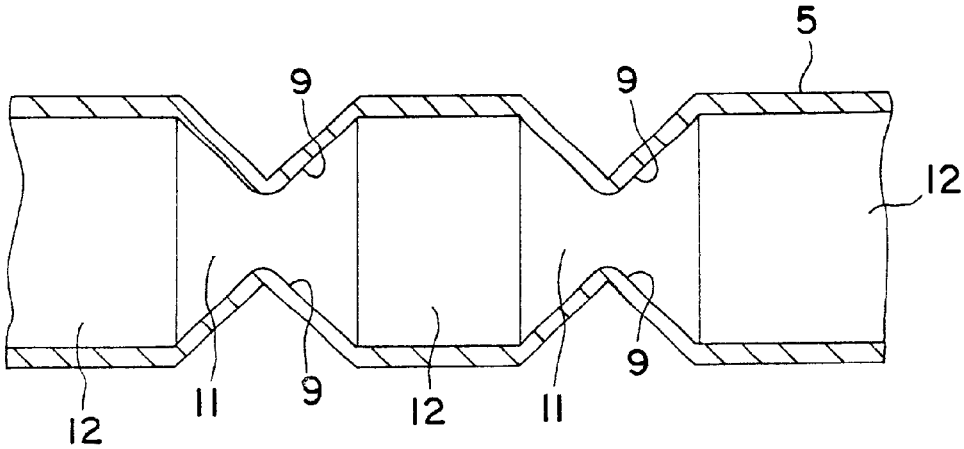
FIG. 7 is a section along 7—7 of FIG. 2.

The formation of the cramping terminal fitting 1 from the electrically conductive plate member 13 is described with reference to FIG. 4. More particularly, the openings 11 are formed substantially in the middle of the plate member 13, and between the portions of the plate member 13 that will become the IDC portions 6 and the guide portions 10. Small openings 14 are provided near the upper and lower ends of the plate member 13 in positions substantially aligned with the openings 11. The triangular guide portions 10 are embossed in positions more outward than the small openings 14. On the other hand, one first cut 15 is made along a transverse direction of FIG. 4 in a position inward from each small opening 14. Further, a vertically extending second cut 16 is formed to extend from a slightly rightward position on the first cut 15 to the small opening 14. In this way, short pieces 17 and long pieces 18 are provided respectively at the right and left sides of the second cuts 16, and will become the cutting blades 8 of the IDC portions 6, as described below. When the cutting blades 8 are formed, the leading ends of the long pieces 18 are exposed at positions toward the grooves 7 and the short pieces 17 support the long pieces 18 by being in contact with the rear sides of the long pieces 18, as shown in FIG. 6(B). Thus, edges 18A of the cut ends at the leading ends of the long pieces 18 form the cutting blades 8 for making cuts in the insulation coating 3B of the wire 3.

Portions of the conductive plate 13 between the first cuts 15 and the openings 11 are embossed in the same direction as the guide portions 10 to become the contact portions 9. The contact portions 9 are stamped by the press to have no cut ends. Hence the plating is held as it is at their front surfaces. Further, the end positions of the edges 18A and the starting positions of the contact portions 9 are aligned with one another on opposite sides of the first cuts 15.

Figure 10:
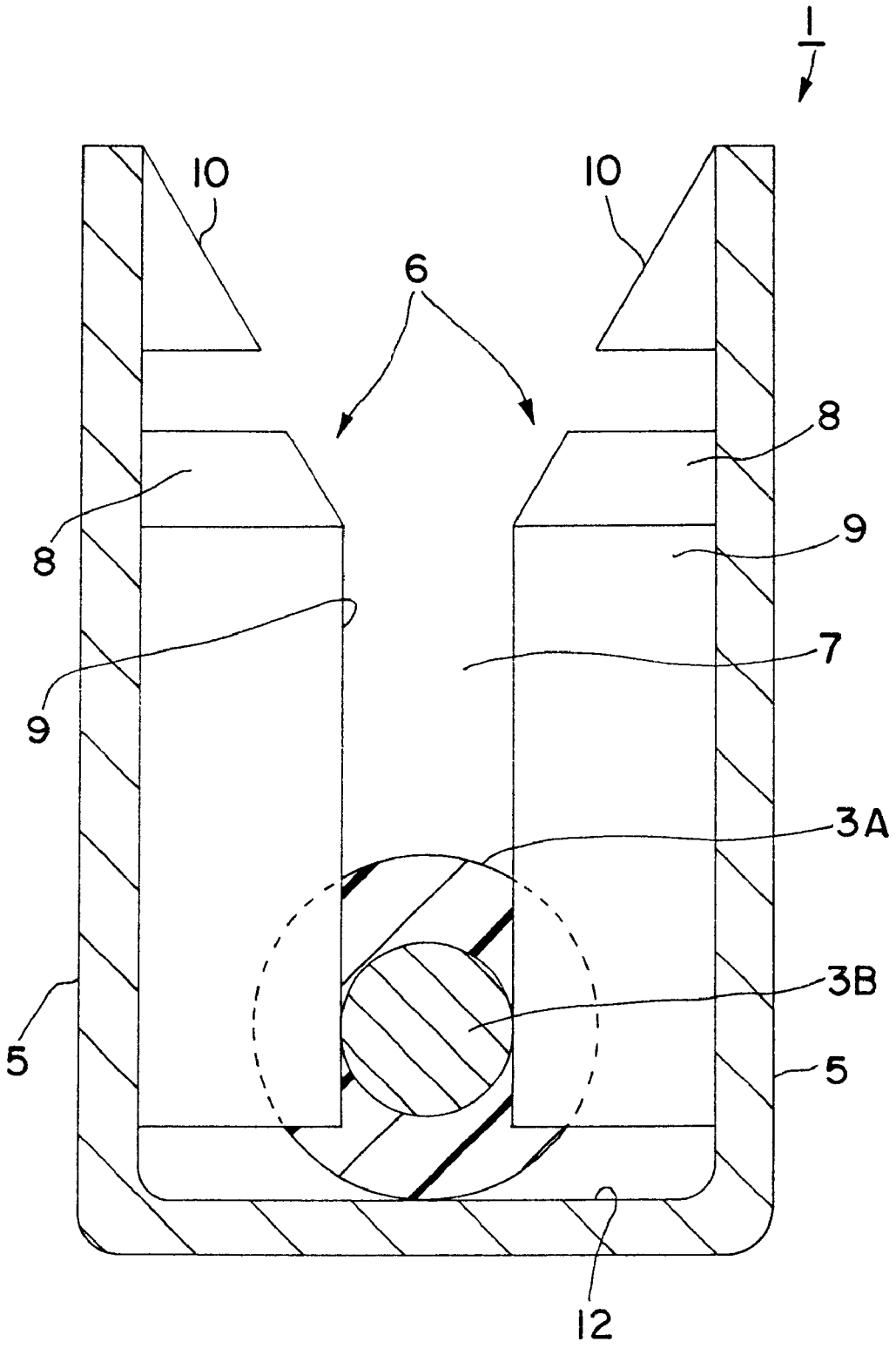
FIG. 10 is a section showing of a state after the insulated wire is mounted in the IDC portion.
Figure 11:
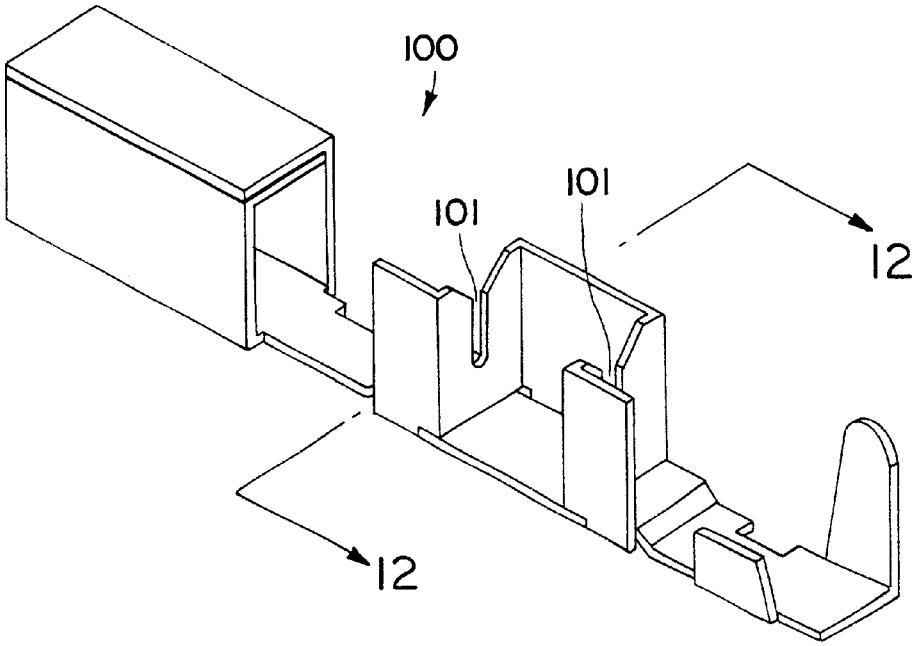
FIG. 11 PRIOR ART
FIG. 11 is a perspective view of a prior art cramping terminal fitting.
Figure 12:
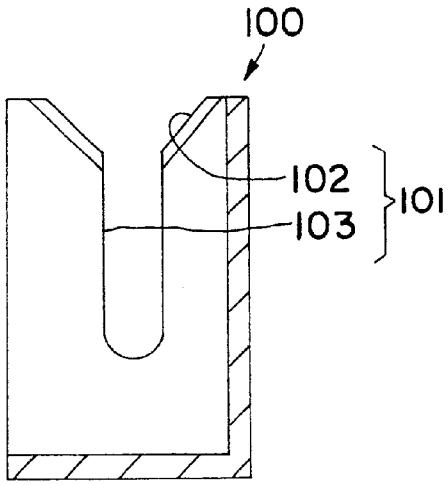
FIG. 12 PRIOR ART
FIG. 12 is a section along 12—12 of FIG. 11.

The terminal fitting 1 in accordance with this embodiment is used as described below with reference to FIGS. 8 to 10. First, as shown in FIG. 8, an end of the wire 3 is positioned above the IDC portions 6 while the extension of the wire 3 is substantially aligned with the forward/backward directions of the terminal fitting 1.

Next, the wire 3 is pushed transversely into the grooves 7. The slanted guide portions 10 will guide the wire efficiently into the grooves 7, and thus will overcome any misalignment or offset of the wire 3 that may exist. Thus, the wire 3 can be pushed smoothly into the grooves 7.

Sufficient pushing will urge the wire 3 into the cutting edges 8 of the IDC portions 6 and will cause the edges 18A to cut through the insulation coating 3A, as shown go in FIG. 9. The insulation coating 3A is cut until the contact portions 9 are brought into contact with the core 3B. More particularly, the wire 3 is pushed to the position shown in FIG. 10 with the contact portions 9 and the core 3B held in contact with each other.

As described above, the wire 3 is pushed into the IDC portions 6 of the cramping terminal fitting 1 sufficiently for the cutting blades 8 to cut through the insulation coating and for the contact portions 9 below the cutting blades 8 to be brought into contact with the core 3B. Since the contact portions 9 are formed by embossing the opposite side walls 5 of the cramping terminal fitting 1 to bulge inward, a satisfactory contact state can be maintained without peeling the plating applied to the front surface of the electrically conductive plate member 13 from which the cramping terminal fitting 1 is formed.

Since the wire 3 is guided to the cutting blades 8 by the guide portions 10 when being pushed into the IDC portions 6, the insulation coating 3A of the wire 3 can be cut smoothly.

Further, since the edges 18A for making cuts in the insulation coating 3A are aligned with the contact portions 9 provided therebelow, the core 3B of the wire 3 can be brought smoothly into contact with the contact portions 9.

In addition, the openings 11 in the bottom wall 12 of the cramping terminal fitting 1 are aligned with the contact portions 9, and hence will prevent the cramping terminal fitting 1 from distorting during the formation of the embossments that define the contact portions 9.

The present invention is not limited to the foregoing embodiment. For example, the following modifications also are embraced by the technical scope of the present invention as defined in the claims.

Although the female cramping terminal fitting 1 is illustrated in the foregoing embodiment, the invention may be applied to male cramping terminal fittings.

Although the guide portions 10 are provided above the IDC portions 6 in the foregoing embodiment, they may not be provided according to the invention.

Although the openings 11 are formed in the bottom wall 12 of the cramping terminal fitting 1 in the foregoing embodiment, they may not be provided according to the invention.

Even though the embossed portions are depicted and described as having a pointed triangular cross section, the embossed portions may have according to the invention also a rounded triangular cross section.

What is claimed is:

1. A terminal fitting for an insulated wire with a core and an insulation coating surrounding the core, the terminal fitting comprising a pair of opposed sidewalls and at least one insulation displacement contact portion formed along the sidewalls, the insulation displacement contact portion being electrically connectable with the core of the insulated wire by cutting the insulation coating as the insulated wire is pushed into the insulation displacement contact portion, the insulation displacement contact portion comprising two opposed V-shaped cutting blades for cutting the insulation coating of the insulated wire and two opposed contact portions disposed respectively below the cutting blades in an insertion direction of the insulated wire, the contact portions being defined by embossing the sidewalls of the terminal fitting inward to define embossed portions that have triangular cross sections a ridge defining an apex of each of the embossed triangular contact portions, the ridges being dimensioned for tightly holding the core between opposed ridges of the embossed triangular contact portions, each said V-shaped cutting blade defining an apex intersecting the respective ridge of the embossed triangular contact portion at an acute angle, each said insulation displacement contact portion further having two opposed embossed triangular guide portions disposed above and spaced from the respective V-shaped cutting blade for guiding the wire toward the cutting blades of the respective insulation displacement contact portion, each said guide portion further having a ridge aligned with the ridge of the respective embossed triangular contact portion and with the apex of the respective cutting blade.

2. A terminal fitting according to claim 1, wherein the terminal fitting is formed by bending an electrically conductive plate member that has one surface plated.

3. A terminal fitting according to claim 2, wherein the cutting blades are formed by edges of cut ends obtained when the electrically conductive plate member is cut, end positions of the edges being aligned with the embossed triangular contact portion.

4. A terminal fitting according to claim 1, wherein at least one opening is formed in a portion of a bottom portion of the terminal fitting at a location aligned with the insulation displacement contact portion, the opening extending completely between the opposed sidewalls for avoiding a distortion of the terminal fitting when the insulation displacement contact portion is formed by embossing.

5. A terminal fitting for an insulated wire, the wire having a core and an insulation coating surrounding the core, the terminal fitting comprising: a bottom wall, first and second opposed sidewalls extending up from the bottom wall and a wire receiving space defined between the sidewalls, at least one insulation displacement contact portion formed along the sidewalls, the insulation displacement contact portion comprising first and second opposed embossments formed respectively on the first and second sidewalls and projecting into the wire receiving space, each said embossment comprising a pair of panels formed inwardly from the respective sidewall and meeting at an elongate ridge extending up from the bottom wall, the ridges of the opposed embossments of the insulation displacement contact portion being spaced from one another for tightly holding the core of the wire between the ridges of the opposed embossments, V-shaped cutting blades being formed on the respective embossments and facing away from the bottom wall, each V-shaped cutting blade being formed from a short blade piece, as measured from the respective sidewall, and a long blade piece, as measured from the respective sidewall, the short and long blade pieces being separated from one another by cut edges, portions of the long blade piece adjacent the cut edge thereof contacting the cut edge of the short blade piece, the cut edge of the long blade piece intersecting the ridge of the respective embossment and being configured for cutting the insulation coating of the wire.

6. The terminal fitting of claim 5, wherein the cut edge of the long blade piece is aligned at an acute angle to the ridge of the respective embossed triangular contact portion.

7. The terminal fitting of claim 6, further comprising an embossed triangular guide portion disposed above and spaced from each of the respective V-shaped cutting blades.

8. A terminal fitting for an insulated wire, the wire having a core and an insulation coating surrounding the core, the terminal fitting comprising: a bottom wall, first and second opposed sidewalls extending up from the bottom v&l and a wire receiving space defined between the sidewalls, at least one insulation displacement contact portion formed along the sidewalls, the insulation displacement contact portion comprising first and second opposed embossments formed respectively on the first and second sidewalls and projecting into the wire receiving space, each said embossment comprising a pair of panels formed inwardly from the respective sidewall and meeting at an elongate ridge extending up from the bottom wall, the ridges of the opposed embossments of the insulation displacement contact portion being spaced from one another for tightly holding the core of the wire between the ridges of the opposed embossments, V-shaped cutting blades being formed on the respective embossments and facing away from the bottom wall, the bottom wall having an opening extending completely between the sidewalls of the terminal fitting at locations-aligned with the insulation displacement contact portion.

* * * * *